US006785915B1

(12) United States Patent
Daugherty

(10) Patent No.: US 6,785,915 B1
(45) Date of Patent: Sep. 7, 2004

(54) PERSONAL HYGIENE CLEANING APPARATUS

(76) Inventor: Lindy Daugherty, 710 Sojourn Rd., New Lenox, IL (US) 60451

( * ) Notice: Subject to any disclaimer, the term of this patent is extended or adjusted under 35 U.S.C. 154(b) by 0 days.

(21) Appl. No.: 10/036,556

(22) Filed: Dec. 31, 2001

(51) Int. Cl.[7] ..... A61H 35/00

(52) U.S. Cl. ..... 4/448; 4/443; 4/420.1; 4/420.4

(58) Field of Search ..... 4/420.1–420.5, 4/443–448; 239/104, 195, 197, 198, 310, 375, 530, 531, 583, 586, 587.1

(56) References Cited

U.S. PATENT DOCUMENTS

| | | | | | |
|---|---|---|---|---|---|
| 1,658,645 | A | * | 2/1928 | McGee | |
| 1,747,624 | A | * | 2/1930 | Gilsenan | |
| 1,818,388 | A | * | 8/1931 | Farley | |
| 2,344,561 | A | * | 3/1944 | Popil | |
| 2,364,491 | A | * | 12/1944 | Triadou | |
| 2,607,622 | A | * | 8/1952 | Doepke | |
| 3,107,861 | A | * | 10/1963 | Penkoff | |
| 3,256,531 | A | | 6/1966 | Arsensberg | |
| 3,973,558 | A | * | 8/1976 | Stouffer et al. | |
| 4,000,742 | A | * | 1/1977 | Digicomo | |
| 4,123,808 | A | | 11/1978 | Guarrera | |
| 4,242,764 | A | | 1/1981 | Fukuda | |
| 4,287,618 | A | * | 9/1981 | Silver | |
| 4,349,288 | A | | 9/1982 | Bond | |
| 4,582,257 | A | * | 4/1986 | Siegler | 237/197 |
| 4,650,470 | A | * | 3/1987 | Epstein | 239/310 |
| 4,793,331 | A | * | 12/1988 | Stewart | |
| 4,995,121 | A | | 2/1991 | Barker | |
| 4,998,300 | A | * | 3/1991 | Sharifzadeh | |
| 5,095,893 | A | * | 3/1992 | Rawden, Jr. | |
| 5,142,711 | A | | 9/1992 | Parikh | |
| 5,220,914 | A | * | 6/1993 | Thompson | |
| 5,274,856 | A | * | 1/1994 | Bernard et al. | |
| 5,738,668 | A | * | 4/1998 | Bugajski | |
| 5,742,961 | A | * | 4/1998 | Casperson et al. | |
| 5,782,412 | A | * | 7/1998 | Plantz et al. | 239/197 |
| 5,799,341 | A | | 9/1998 | Rodas | |
| 5,937,451 | A | * | 8/1999 | Mihara | |
| 5,987,659 | A | * | 11/1999 | Cannizzaro | |
| 6,105,179 | A | | 8/2000 | Burns | |
| 6,116,521 | A | * | 9/2000 | Miyake | 239/310 |
| 6,209,800 | B1 | * | 4/2001 | Thomas | 239/195 |
| 6,419,166 | B1 | * | 7/2002 | Brzezinski et al. | 239/310 |

FOREIGN PATENT DOCUMENTS

| | | | | |
|---|---|---|---|---|
| DE | 502700 | * | 7/1930 | 4/448 |
| GB | 329498 | * | 5/1930 | 4/443 |
| WO | WO 9103974 | * | 4/1991 | 4/443 |

* cited by examiner

*Primary Examiner*—Amanda Flynn
(74) *Attorney, Agent, or Firm*—John D. Gugliotta; P. Jeff Martin; Olen L. York, III

(57) ABSTRACT

A personal hygiene cleansing tool, is provided as an apparatus to aid in cleansing body parts in a medical environment. The invention connects to a standard faucet on a sink, and provides a flow of water to a cleansing wand through a flexible plastic hose mounted on a retractable reel. The wand contains controls for adjusting the flow rate of the water, along with an adjustable head to provide a water flow from a stream to a mist. Additionally, the invention has a siphon arrangement to allow the addition of medicine into the water stream. The medicine is placed into a sealed chamber and then drawn out in an incremental manner as the water flows by. It is envisioned that the invention would be used in a hospital environment for the cleansing of wounds or for the bathing of individuals who cannot withstand the impact of water from a shower.

21 Claims, 3 Drawing Sheets

PERSONAL HYGIENE CLEANING APPARATUS

RELATED APPLICATIONS

The present invention was first described in Disclosure Document Number 493,317 filed on May 10, 2001 under 35 U.S.C. §122 and 37 C.F.R. §1.14. There are no previously filed, nor currently any co-pending applications, anywhere in the world.

FIELD OF THE INVENTION

This invention relates to a device for improving personal hygiene. More particularly, the invention relates to a user-friendly, portable wand type personal cleansing tool.

BACKGROUND OF THE INVENTION

Individuals with skin disorders, wounds, burns and the like, know all too well of some of the difficulties that they encounter in daily life. Ordinary tasks that most of us take for granted, causes them, or their care takers, severe hardship on a daily basis. One of these tasks is the simple act of bathing. While some can bathe in a tub or shower, many cannot withstand the pain associated with the water pressure exerted on their skin by a shower head. These same difficulties are encountered in hospitals, where nurses must cleanse patients' wounds. Often a squeeze bottle is used, but it must constantly be refilled.

The present invention is designed and particularly adapted to be used for personal hygiene and cleaning, particularly in a bathing or showering environment.

A search of the prior art did not disclose any patents that read directly on the claims of the instant invention; however, the following references were considered related:

The following patents disclose a bidet assembly for attachment to a conventional toilet bowl:

U.S. Pat. No. 5,142,711 issued in the name of Parikh

U.S. Pat. No. 4,995,121 issued in the name of Barker

U.S. Pat. No. 3,256,531 issued in the name of Arensberg

U.S. Pat. No. 6,105,179 issued in the name of Burns describes a toilet/bidet device for cleaning genitals comprising a water conduit wand.

U.S. Pat. No. 5,779,341 issued in the name of Rodas discloses a combination toilet and bidet system.

U.S. Pat. No. 4,349,288 issued in the name of Bond describes a hand-held washcloth with liquid-chargeable pouch for cleaning the genitals.

U.S. Pat. No. 4,242,764 issued in the name of Fukuda discloses a hygienic cleaning apparatus for a toilet.

U.S. Pat. No. 4,123,808 issued in the name of Guarrera describes a bathtub with a spray outlet converted to a recto-genital cleaning device.

Accordingly, there exists a need for a means by which those suffering from skin disorders, wounds, and the like can be cleansed thoroughly in an easier manner without pain or suffering.

BRIEF SUMMARY OF THE INVENTION

The device described by the invention is a user-friendly, personal hygiene cleaning apparatus.

Briefly described according to one embodiment of the present invention, a directional flow nozzle is affixed to a control housing by a quick-connect coupling. The directional flow nozzle has an angularly disposed extension conduit terminating by forming a discharge orifice. A splash guard is radially extended outward from the shaft of the extension conduit. A flow control means provides single handed manipulation of the fluid flowrate. Various embodiments of methods of connecting the apparatus to a fluid source are anticipated, included a shower adapter, a faucet adapter, and an adapter to be affixed to an infusion pump on an IV pole that will deliver sterile water or saline to the device.

The device of the invention may be used at home or taken on travel and used in hotels and medical facilities due to its portability and ease of connection and disconnection.

Further, the invention has no electrical parts and very few moving parts. Thus maintenance relating to pumps and motors is eliminated.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

The best mode for carrying out the invention is presented in terms of its preferred embodiment, herein depicted within the Figures.

Figure 1:
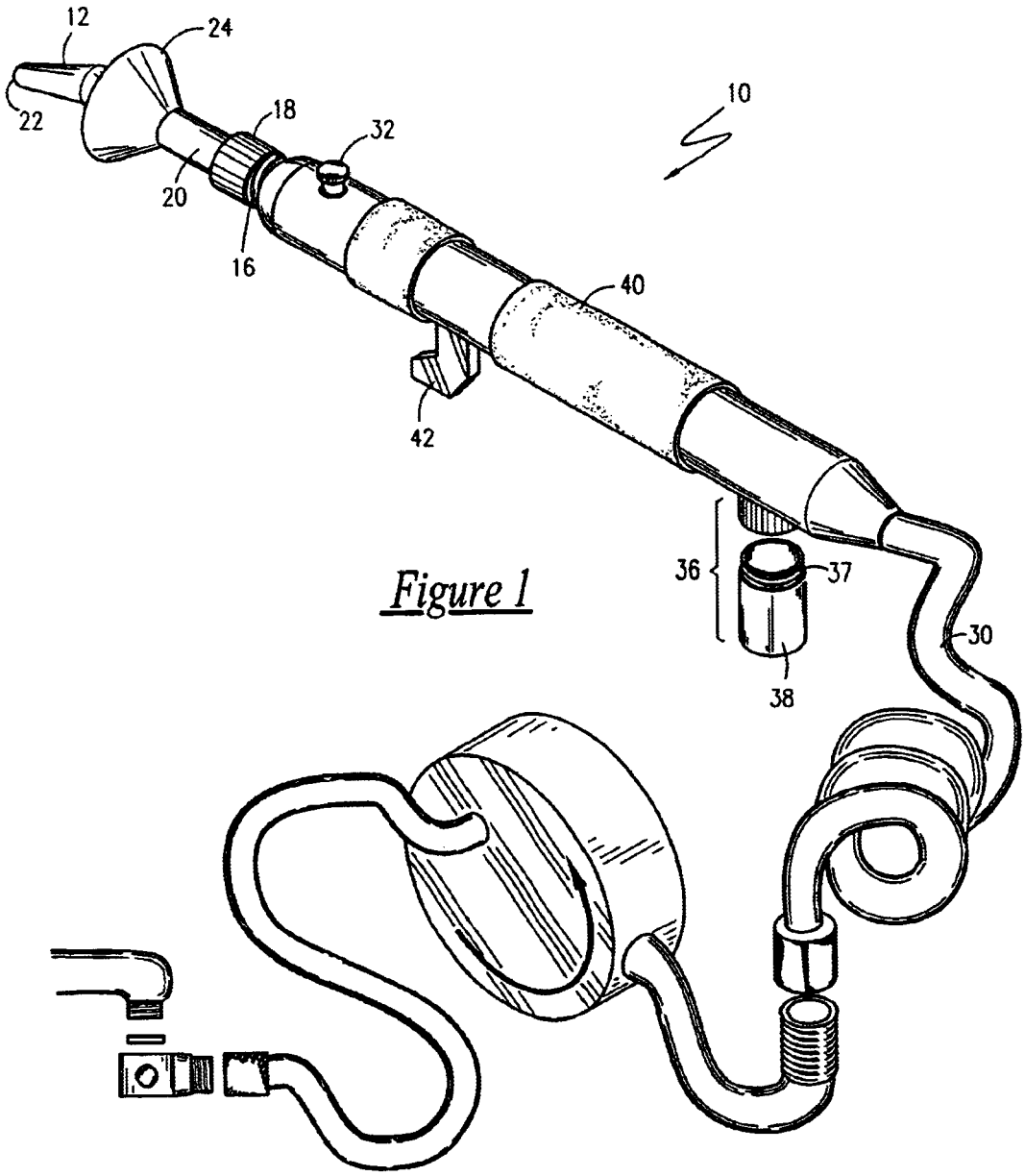
FIG. 1 is a perspective view of a personal hygiene cleansing tool constructed according to the principles of the invention.

Referring now to FIG. 1, a personal hygiene cleaning apparatus 10 is shown according to the preferred embodiment of the present invention in which a directional flow nozzle 12 is affixed to a control housing 14. The control housing 14 is linearly elongated, and has a connection means 16 at a distal end that connects in a removable, replaceable fashion to an attachment means 18 on the flow nozzle 12. This attachment means/connection means assembly is anticipated as being capable of providing a simple quick-connect coupling arrangement of the type currently available. The directional flow nozzle 12 has an angularly disposed first extension conduit 20 terminating opposite the attachment means 18 by forming a discharge orifice 22. A splash guard 24 is anticipated as being radially extended outward from the shaft of the first extension conduit 20 such as to form a barrier perpendicularly thereto.

In greater detail, the control housing 14 extends with a flexible second extension conduit 30 opposite the connection means 16 such as to be in fluid communication with the directional flow nozzle 12 through the control housing 14. The flexible second extension conduit 30 may be mounted to a retractable reel, thereby providing a user the versatility of unrolling the hose to varied lengths for use of the personal hygiene cleansing apparatus 10 at distances away from a faucet, shower head or other water source. A flow control means 32 functioning as a valving mechanism allows for flow control of discharged fluid in order to adjust the pressure and volume of released fluid. An introduction orifice 36 surrounded by a threaded connection 37 allows attachment of a reservoir 38 in a threaded manner. The reservoir 38 is anticipated as being capable of being filled with surfactant, antiseptic, medication, or any other water soluble material intended for topical application to the skin through a water-spray delivery means.

Externally, the control housing 14 is anticipated as having a grip 40 formed of a frictionally enhanced material circumscribing the outer surface of the control housing 14 for providing increased ease of hand manipulation. A support protuberance 42 extending radially outward in one plane from the outer surface of the control housing 14 allows for resting of the apparatus 10 on a horizontal surface without damaging the angularly disposed tip of the nozzle 12.

Figure 2:
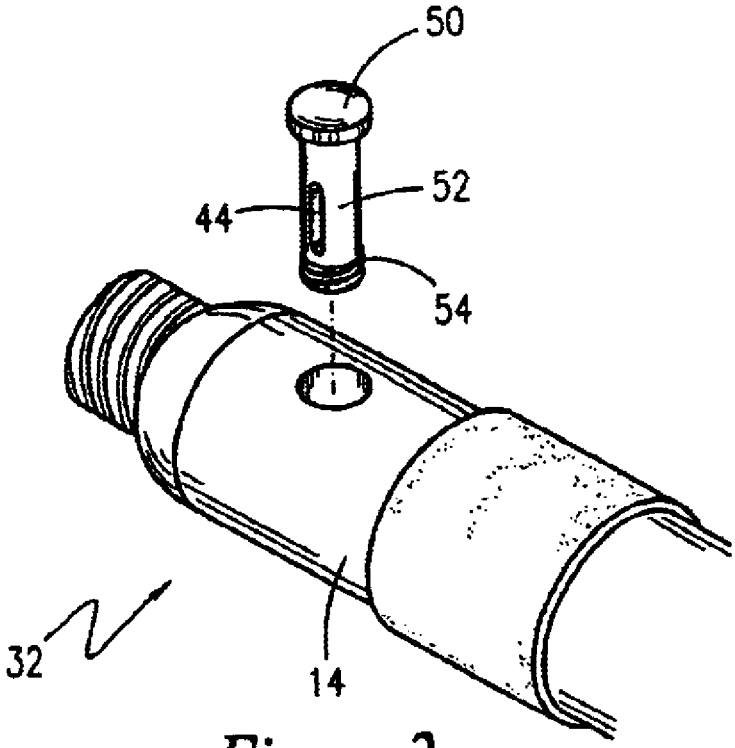
FIG. 2 is a partial exploded perspective view of a water regulator for use therewith.

Referring now to FIG. 2, the flow control means 32 is shown in greater detail. A radially extended button 50 terminates a cylindrical shaft 52 that inserts into the control housing 14. A vertically extended slot 44 formed vertically within the shaft 52 and penetrating horizontally therethrough allows for greater passage of fluid in greater volumes and rates as the shaft 52 is inserted further into the housing 14. A shaft 52 is spring biased upward by a spring means 54. Other anticipated configurations can be formed such as to provide single handed manipulation of the fluid flowrate.

Figure 3:
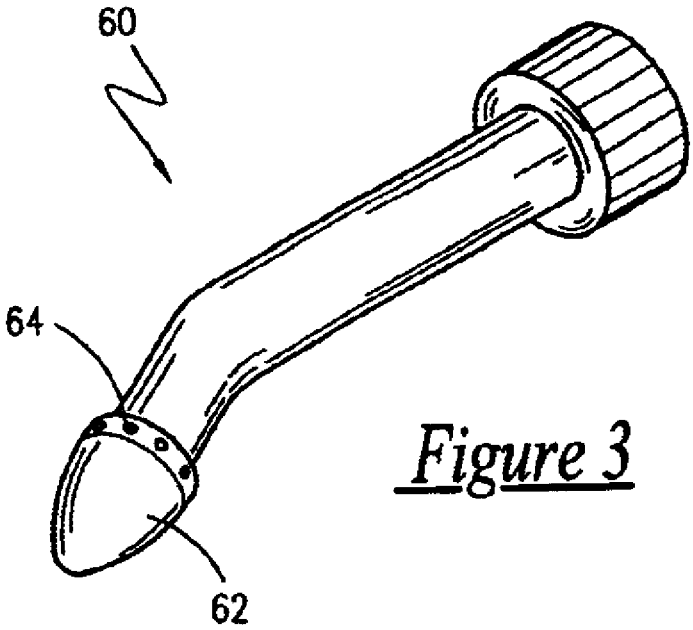
FIG. 3 is an alternate wand tip attachment for use therewith.

Referring now FIG. 3, a replaceable embodiment for the directional flow nozzle 60 14 is disclosed. The replaceable nozzle 60 further includes a cap 62 having a plurality of discharge orifices 64 at the tip such as to generate a gentle shower of fluid, or a powerful stream, when engaged.

Figure 4:
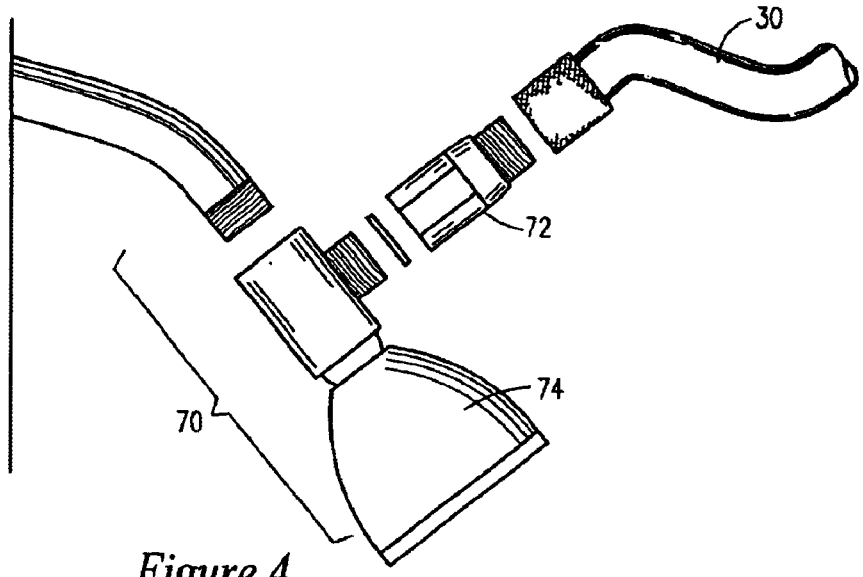
FIG. 4 is an exploded elevational view of a shower adapter for use therewith.
Figure 5:
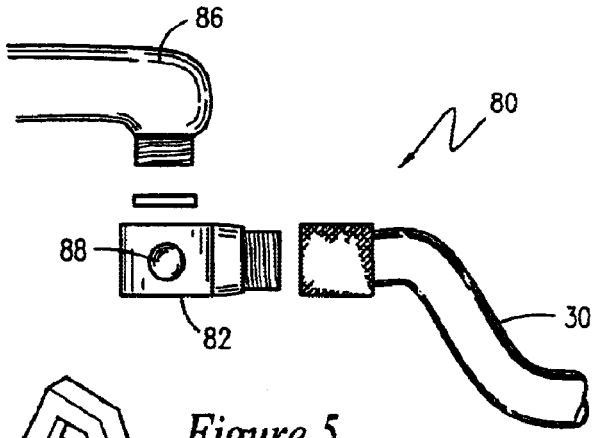
FIG. 5 is an exploded elevational view of a faucet adapter for use therewith.
Figure 6:
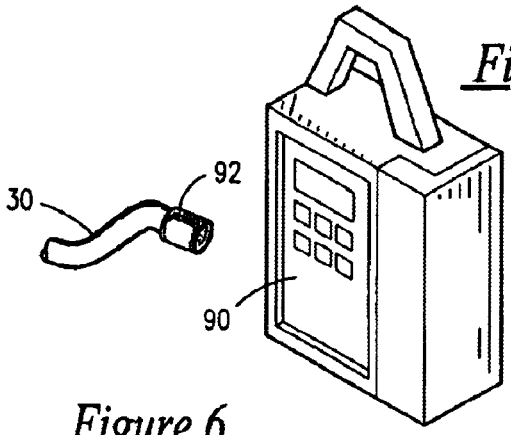
FIG. 6 is an exploded elevational view of a portable bottle adapter for use therewith.

FIGS. 4–6 show various embodiments of methods of connecting the apparatus 10 to a fluid source. According to FIG. 4, a shower adapter 70 is shown in which the flexible second extension conduit 30 is shown as a hose terminated opposite the control housing 14 at a first connection fitting 72 designed to integrate with a shower head 74. Such a configuration will allow fluid to flow alternately between the shower head 74 and the flexible second extension conduit 30.

According to FIG. 5, a faucet adapter 80 is shown in which the flexible second extension conduit 30 is shown as a hose terminated opposite the control housing 14 at a second connection fitting 82 designed to affix in a threaded manner to a conventional faucet or spigot 86. The addition of a toggle switch 88 will allow fluid flow to be controlled to the flexible second extension conduit 30.

Finally, FIG. 6 shows how the device can be used in a medical facility in that it can be readily attached to an infusion pump on an IV pole. A female threaded cap 92 allows the flexible second extension conduit 30 to connect to and be in fluid communication with the infusion pump 90. It is envisioned that for storage purposes, the device can be conveniently attached to the side of the infusion pump 90.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A personal hygiene cleaning apparatus comprising:

a directional flow nozzle having an attachment means;

a control housing in fluid communication with said directional flow nozzle, said control housing being linearly elongated and having a connection means at a distal end that connects in a removable, replaceable fashion to said attachment means on said flow nozzle;

an angularly disposed first extension conduit depending from said directional flow nozzle and terminating opposite said attachment means and thereby forming a discharge orifice;

a flexible second extension conduit in fluid communication with said control housing opposite said connection means such as to be in fluid communication with said directional flow nozzle through the control housing, wherein said flexible second extension conduit is mounted to a retractable reel, thereby providing variation in said flexible second extension conduit length;

a flow control means functioning as a valving mechanism allows for flow control of discharged fluid in order to adjust the pressure and volume of released fluid; and a shower adapter in which the flexible second extension conduit is connectable opposite the control housing at a first connection fitting.

2. A personal hygiene cleaning apparatus comprising:

a directional flow nozzle having an attachment means;

a control housing in fluid communication with said directional flow nozzle, said control housing being linearly elongated and having a connection means at a distal end that connects in a removable, replaceable fashion to said attachment means on said flow nozzle;

an angularly disposed first extension conduit depending from said directional flow nozzle and terminating opposite said attachment means and thereby forming a discharge orifice;

a flexible second extension conduit in fluid communication with said control housing opposite said connection means such as to be in fluid communication with said directional flow nozzle through the control housing, wherein said flexible second extension conduit is mounted to a retractable reel, thereby providing variation in said flexible second extension conduit length; and a faucet adapter in which the flexible second extension conduit is connectable opposite the control housing at a second connection fitting designed to affix in a threaded manner to a conventional faucet or spigot, wherein said faucet adapter has a toggle switch for controlling the flow of fluid from said faucet or spigot.

3. A personal hygiene cleaning apparatus comprising:

a directional flow nozzle having an attachment means;

a control housing in fluid communication with said directional flow nozzle, said control housing being linearly elongated and having a connection means at a distal end that connects in a removable, replaceable fashion to said attachment means on said flow nozzle;

an angularly disposed first extension conduit depending from said directional flow nozzle and terminating opposite said attachment means and thereby forming a discharge orifice;

a flexible second extension conduit in fluid communication with said control housing opposite said connection means such as to be in fluid communication with said directional flow nozzle through the control housing, wherein said flexible second extension conduit is mounted to a retractable reel, thereby providing variation in said flexible second extension conduit length; and a female threaded cap that allows said flexible second extension conduit to connect to and be in fluid communication with a medical infusion pump.

4. The personal hygiene cleaning apparatus of claim 1, wherein said attachment means and said connection means form an assembly provided by a simple quick-connect coupling.

5. The personal hygiene cleaning apparatus of claim 9, wherein said directional flow nozzle has an angularly disposed extension conduit terminating opposite said attachment means by forming a discharge orifice.

6. The personal hygiene cleaning apparatus of claim 1, further comprising a splash guard radially extended outward from the extension conduit such as to form a barrier angularly thereto.

7. The personal hygiene cleaning apparatus of claim 1, further comprising an introduction orifice surrounded by a threaded connection to allow attachment of a reservoir in a threaded manner, said reservoir being capable of being filled with water soluble material intended for topical application to the skin through a water-spray delivery.

8. The personal hygiene cleaning apparatus of claim 1, further comprising a grip formed of a frictionally enhanced material circumscribing the outer surface of the control housing.

9. The personal hygiene cleaning apparatus of claim 1, further comprising a support protuberance extending radially outward in one plane from the outer surface of the control housing.

10. The personal hygiene cleaning apparatus of claim 2, wherein said attachment means and said connection means form an assembly provided by a simple quick-connect coupling.

11. The personal hygiene cleaning apparatus of claim 2, wherein said directional flow nozzle has an angularly disposed extension conduit terminating opposite said attachment means by forming a discharge orifice.

12. The personal hygiene cleaning apparatus of claim 2, further comprising a splash guard radially extended outward from the extension conduit such as to form a barrier angularly thereto.

13. The personal hygiene cleaning apparatus of claim 2, further comprising an introduction orifice surrounded by a threaded connection to allow attachment of a reservoir in a threaded manner, said reservoir being capable of being filled with water soluble material intended for topical application to the skin through a water-spray delivery.

14. The personal hygiene cleaning apparatus of claim 2, further comprising a grip formed of a frictionally enhanced material circumscribing the outer surface of the control housing.

15. The personal hygiene cleaning apparatus of claim 2, further comprising a support protuberance extending radially outward in one plane from the outer surface of the control housing.

16. The personal hygiene cleaning apparatus of claim 3, wherein said attachment means and said connection means form an assembly provided by a simple quick-connect coupling.

17. The personal hygiene cleaning apparatus of claim 3, wherein said directional flow nozzle has an angularly disposed extension conduit terminating opposite said attachment means by forming a discharge orifice.

18. The personal hygiene cleaning apparatus of claim 3, further comprising a splash guard radially extended outward from the extension conduit such as to form a barrier angularly thereto.

19. The personal hygiene cleaning apparatus of claim 3, further comprising an introduction orifice surrounded by a threaded connection to allow attachment of a reservoir in a threaded manner, said reservoir being capable of being filled with water soluble material intended for topical application to the skin through a water-spray delivery.

20. The personal hygiene cleaning apparatus of claim 3, further comprising a grip formed of a frictionally enhanced material circumscribing the outer surface of the control housing.

21. The personal hygiene cleaning apparatus of claim 3, further comprising a support protuberance extending radially outward in one plane from the outer surface of the control housing.

* * * * *